United States Patent [19]

Saito et al.

[11] 3,965,686

[45] June 29, 1976

[54] DRAIN SHEET MATERIAL

[75] Inventors: Jiro Saito, Tokyo; Kaoru Kimura, Iruma; Hiroshi Kusuhara; Kazuyoshi Nakaguma, both of Tokyo, all of Japan

[73] Assignees: Ohbayashi-Gumi, Ltd., Osaka; Japan Vilene Company, Ltd., Tokyo, both of Japan

[22] Filed: Sept. 22, 1975

[21] Appl. No.: 615,707

Related U.S. Application Data

[63] Continuation of Ser. No. 489,047, July 16, 1974, abandoned.

[30] Foreign Application Priority Data

Mar. 4, 1974 Japan ..... 49-25049

[52] U.S. Cl. ..... 61/11; 61/13; 210/486

[51] Int. Cl.[2] ..... E02B 11/00

[58] Field of Search ..... 61/11, 12, 13, 10, 35, 61/36; 210/486, 491, 65, 490, 499, 498, 489, 487, 492, 494, 170

[56] References Cited

UNITED STATES PATENTS

| | | | |
|---|---|---|---|
| 1,015,401 | 1/1912 | Robison | 61/13 |
| 2,902,165 | 9/1959 | Imershein | 210/486 |
| 3,260,370 | 7/1966 | Schwartzwalder | 210/492 X |
| 3,371,785 | 3/1968 | Hanami | 210/486 X |
| 3,441,140 | 4/1969 | Thurber | 61/11 UX |
| 3,563,038 | 2/1971 | Healy et al. | 210/486 |
| 3,679,062 | 7/1972 | Burkhart | 210/486 |
| 3,830,373 | 8/1974 | Sixt et al. | 61/11 X |

FOREIGN PATENTS OR APPLICATIONS

| | | | |
|---|---|---|---|
| 2,017,732 | 10/1971 | Germany | 61/11 |
| 4,873 | 1/1901 | United Kingdom | 210/486 |

*Primary Examiner*—Dennis L. Taylor

*Attorney, Agent, or Firm*—Wenderoth, Lind & Ponack

[57] ABSTRACT

A flexible elongated member is embedded in a coarse non-woven fabric layer. The flexible elongated member has partially opened circumferential portions through which water enters into the flexible member, the circumferential portions and inside thereof forming a continuous drain passage not blocked by deformation of the flexible member.

2 Claims, 10 Drawing Figures

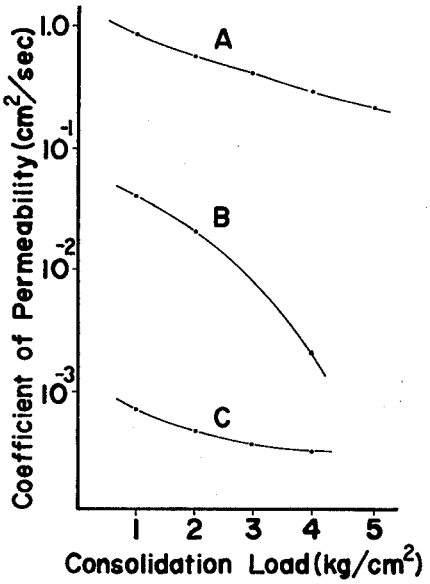
FIG. 4
FIG. 5
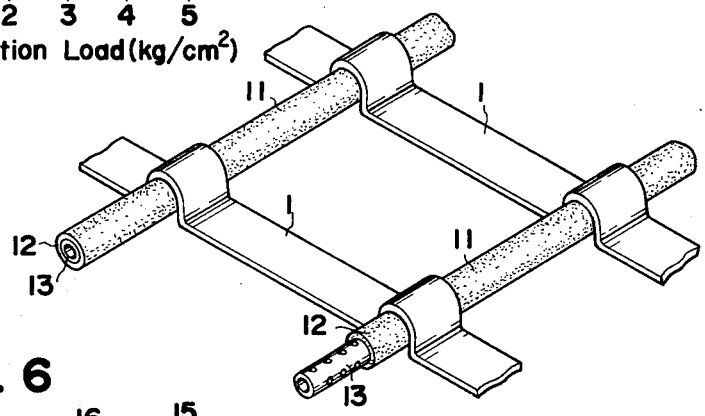
FIG. 6
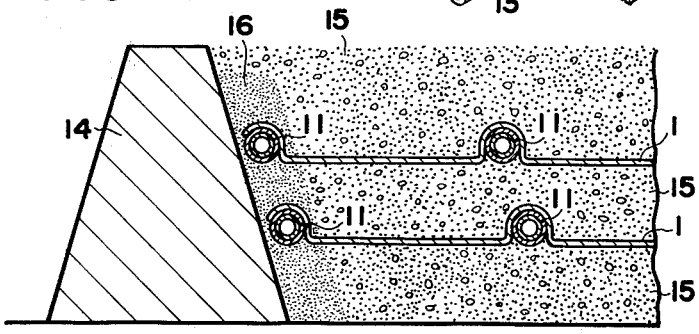

DRAIN SHEET MATERIAL

This is a continuation of application Ser. No. 489,047, filed July 16, 1974.

BACKGROUND OF THE INVENTION

This invention relates to a drain sheet material to be used for draining excessive pore water from soil.

In a known drain sheet material, a plurality of grooves or channels are formed in the lengthwise direction of a sheet material made of water-permeable paper or non-woven fabric for draining pore water from soil. However, in such a structure of the drain sheet material, when the sheet material in the wet condition is compressed by high earth pressure, the grooves in the sheet material are deformed with the result that the drainage of the pore water will be greatly deteriorated. On the other hand, when the sheet material is made of hard material to prevent the grooves therein from being deformed by the earth pressure, the sheet material itself will be broken easily and the water-permeability thereof will be less. Thus, it has been difficult to provide a drain sheet material in which the drain function of the grooves is maintained without deteriorating the water-permeability of the sheet material itself even when it is used under high earth pressure.

SUMMARY OF THE INVENTION

Accordingly, an object of the present invention is to provide a drain sheet material or element having high water-permeability and durability, wherein passages for collecting and draining pore water well function without being blocked even when the drain sheet material is buried in any kind of soil under high earth pressure.

Another object of the present invention is to provide a drain structure suited for draining water from muddy soil having high water content in per cent of dry weight.

A further object of the present invention is to provide a drain structure for draining pore water from a filling having an extrasensitive ratio.

A drain sheet material according to the present invention comprises a non-woven fabric layer of coarse structure in which fibers of relatively high denier are randomly interconnected mainly at their cross points, and a flexible elongated member embedded in the lengthwise direction of the fabric layer and having partially opened circumferential portions through which water enters the flexible member, the circumferential portions and inside thereof forming a continuous drain passage not blocked by deformation of the flexible member.

Preferably, the flexible elongated member is a spiral spring embedded in said non-woven fabric layer.

BRIEF DESCRIPTION OF THE DRAWINGS

The aforementioned and other objects and features of the present invention will be apparent from the following detailed description of specific embodiments thereof, when read in conjunction with the accompanying drawings, in which:

FIG. 4 is a graph comparing degrees of permeability between the present drain sheet material shown in FIG. 1 and conventional ones, FIG. 5 is a perspective view partially showing a drain structure of the present invention constructed by the present drain sheet materials and drain pipes, FIG. 6 is a sectional front view showing the drain structure of FIG. 5 buried in muddy soil.

DETAILED DESCRIPTION OF THE INVENTION

Figure 1:
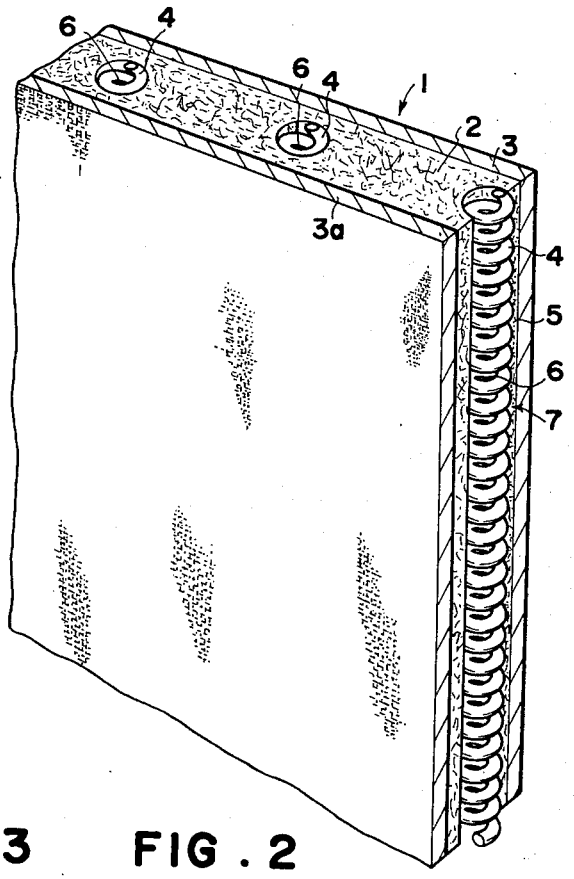
FIG. 1 is a partially sectioned perspective view showing a drain sheet material according to a first embodiment of the present invention.

Referring to a first embodiment shown in FIG. 1, a drain sheet material element 1 of the present invention comprises an intermediate non-woven fabric layer 2 disposed between surface layers 3, 3(a). In the non-woven fabric layer 2, fibers of relatively high denier are randomly interconnected at their cross points by a binder and have high percentage of void of more than 90%, so that the layer 2 is relatively fat and has thickness generally in the range of 3–12 mm. The surface layers 3, 3(a) attached to both sides of the non-woven fabric layer 2 are porous but thinner and more dense than the non-woven fabric layer 2. These surface layers each may be made of an ordinary dense non-woven fabric, another type of non-woven fabric in the form of net film formed by cross lamination of split films, woven fabric, or perforated film. Further, both surface layers 3, 3(a), may be made by combining different types of materials set forth directly above in such a manner that one of the surface layers is of non-woven fabric and the other is of woven fabric.

Within the non-woven fabric layer 2, flexible elongated spiral springs 4 made of metal or plastics are disposed in the lengthwise direction thereof. However, these spiral springs 4 may be partially embedded in the non-woven fabric layer 2. In such a structure, although each spiral spring 4 is closely surrounded by the non-woven fabric of the layer 2 or partially embedded therein, water is permeable through circumferential open spaces 5 between pitches of the spiral spring 4 and comes in an axial continuous space 6 therein. Thus, the spiral spring 3 forms an opened drain passage 7 similar to a hollow pipe provided with a number of openings or perforations through the cylindrical wall thereof. However, the spiral spring is far superior to a hollow cylindrical pipe with respect to flexibility.

Figure 2:
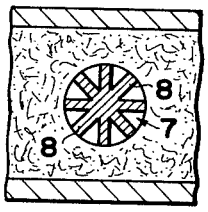
FIG. 2 is a sectional plan view showing a main portion of a drain sheet material according to a second embodiment of the present invention.

Referring to a second embodiment of the present invention shown in FIG. 2, in place of the spiral spring 4, the flexible elongated member is made of eight vanes 8 each extending radially from the center thereof in section, thereby forming partially opened circumferential portions. Spaces defined between every adjacent two vanes 8 form continuous drain passages for the pore water.

Figure 3:
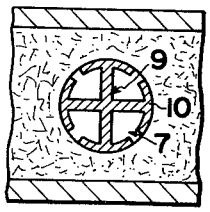
FIG. 3 is a sectional plan view showing a main portion of a drain sheet material according to a third embodiment of the present invention.

In a third embodiment of the present invention shown in FIG. 3, the flexible elongated member is made of four substantially T-shaped fins 9 in section, each extending radially from the center thereof and terminating with an arc-shaped flange portion 10 separated from adjacent flange portions, thereby forming partially opened circumferential portions. Spaces each defined between every adjacent two fins 9 form continuous drain passages 7 for the pore water.

In any of the first to third embodiments, the diameter of each flexible member is preferably in the range of 3–10 mm and the interval between every two adjacent flexible members is more than 5 cm and preferably about 10 cm.

Referring to one of the methods for producing the drain sheet material 1 of the present invention, 70% of nylon of 70 denier and 76 mm length and 30% of acrylonitrile of 43 denier and 76 mm length are mixed to form a web of density of 80 g/m$^2$. A cross linking agent of SBR latex is sprayed on both sides of the web while the latter is compressed. After the latex is hardened, a non-woven fabric layer 2 of density of 180 g/m$^2$, thickness of about 8 mm, and 90% of void is obtained. On one surface of the thus formed non-woven fabric layer 2, a surface layer 3 of non-woven fabric is pasted. This surface layer 3 is made by forming a web of 22 g/m$^2$ density containing 35% of polyester of 3 denier and 64 mm length and 65% of rayon of 3 denier and 51 mm length, and by applying a latex of acrylic ester to form a layer of 40 g/m$^2$ density and 0.35 mm thick. On the other surface of the non-woven fabric layer 2, elongated flexible spiral springs 4 each made of plastics and having a diameter of 3 mm are juxtaposed in the lengthwise direction of the non-woven fabric layer 2 at intervals of 10 cm and then pressed against the layer 2 to be partially embedded therein, thereby forming a substantially flat surface. Before the spiral spring is pressed against the layer, if desired, an adhesive agent is coated thereon. The surface of the non-woven fabric layer 2, in which the spiral spring 4 is embedded, is pasted to another surface layer 3(a) of plain fabrics of polypropylene slit yarn. After the adhesive agent is dried, the present drain sheet material 1 is obtained.

As is apparent from the disclosure set forth above, each of the elongated flexible members juxtaposed and partially embedded in the non-woven fabric layer 2 has internal and circumferential drain passages, so that even when the elongated flexible member is deformed by high earth pressure, the drain passages cannot be blocked completely and the pore water is drained therethrough.

As shown in FIG. 4, degrees of permeability of the present drain sheet material of the type in FIG. 1 represented by a curve A are far higher than those of the conventional drain sheet materials represented by curves B and C. The drain sheet material of which degrees of permeability are represented by curve B is a chemical board in which non-woven fabrics are pasted on both sides of a core body of vinyl chloride by adhesive, and the other conventional drain sheet material of which degrees of permeability are represented by curve C is a chemical board in which flocculent materials are pressed.

Further, due to the flexibility of the elongated members, the present drain sheet material 1 can be rolled up without any problem and does not exert any bad effect upon the properties of the non-woven fabric layer. On the contrary, with the presence of the elongated flexible member, the non-woven fabric layer 2 cannot be deformed easily by external force and maintains the desired expanded state. Especially, when the spiral spring 4 is used as the flexible member, the spiral spring 4 can follow to the longitudinal expansion and contraction exerted on the non-woven fabric layer 2 by the external force. In addition, as the high denier filaments in the non-woven fabric layer 2 are randomly interconnected at their cross points, other than high water-permeability, the non-woven fabric layer 2 has desired tensile strength and buckling strength high enough to resist against vertical drains by drain-driver. The surface layers 3, 3(a) on both sides of the non-woven fabric layer 2 filtrate the water from soil in order that the non-woven fabric layer 2 may not be clogged and, thereby, high drain efficiency is maintained for a long period.

The present drain sheet material 1 having such a high water-permeability can be used as vertical drain material and horizontal drain material in the same manner as conventional materials. More specifically, the present drain sheet material can be used not only to drain ground-water from a golf course and playground but also to drain pore water from poor subsoil and poor filling to improve the stability thereof or from the subgrade and slope of an embankment.

With the use of the present drain sheet materials 1, a drain structure is provided in accordance with the present invention as shown in FIG. 5. In the drain structure, the drain sheet materials 1 are used in combination with drain pipes 11. Each drain pipe has a water-permeable mat 12 covering the outer surface of a perforated pipe 13. The present drain sheet materials are disposed at right angles with the drain pipes to cross over the latter in close contact therewith at the intersections.

The drain structure shown in FIG. 5 is very advantageous when used to drain excessive water from a muddy soil, such as waste slurry from a factory, having high water content in per cent of dry weight. In the embodiment shown in FIG. 6, a reclamation is performed behind a banking 14 in muddy soil 15. The drain pipes 11 are parallelly placed on the muddy soil after the latter is piled to a predetermined height. Then, the drain sheet materials 1 of the present invention are placed at right angles with the drain pipes 11 to cross over the latter in close contact therewith at intersections, thus forming a checker board pattern when seen from the top. Preferably, both of the drain pipes 11 and the drain sheet materials 1 are somewhat inclined relative to the horizontal level to allow smooth movement of the water therein. One of the drain pipes 11 adjacent to the banking 14 and the drain sheet material 1 thereon are set in position by sand 16 filled between the banking and the muddy soil. In the same manner, after the muddy soil 15 is piled successively to a predetermined level on the drain pipes 11 and the drain sheet materials 1 of the lower level, another set of the drain pipes 11 and drain sheet materials 1 are placed thereover. Such reclamation is repeatedly carried out.

With such a structure of the drain pipes and drain sheet materials, a great amount of water in the muddy soil is not only collected in the perforated pipe 13 directly through the mat 12 but also collected therein through the present drain sheet material 1 since the water filtrated by the surface layers 3, 3(a) and entered into the non-woven fabric layer 2 moves along the inclination of the elongated flexible members up to the drain pipes 11. The water coming up to the drain pipe 11 is collected therein due to the reduced pressure in the pipe. To facilitate faster drainage, the water collected in the drain pipes can be pumped out of the banking 14, which makes it possible to consolidate the soil fastly.

In view of the fact that, conventionally, the water in such muddy soil has been drained by a sheet material such as drain paper or cloth covering almost the entire area to be reclaimed, the present drain structure of FIG. 6 is more economical and requires less time for placing in the soil than the conventional drain structure.

In connection with the high water-permeability of the present drain sheet material, an additional advantage can be obtained such that the end portions of the drain sheet materials 1 buried in the embankment are exposed through the face of the slope and thereby keep the soil of the slope in a wet condition suitable for growing a lawn. The growing lawn prevents the washout of the face of the slope. On the other hand, when the present drain sheet materials 1 are buried in poor soil filling, the water drained from the ends of the sheet material is likely to soften the face of the slope of the embankment, so that it is necessary to provide a drainage appliance such as drainage ditch to collect and discharge the water drained from the present drain sheet material. To stabilize the surface of a slope of such a soil as is easily washed-out by rainfall, it was noted that the present drain sheet materials 1 buried as deep as 2–3 m from the top surface of the soil fastly drain the water penetrating through the soil, thereby preventing the surface of the slope from becoming weak by swelling. Further, the surface of the slope is stabilized with an increased shearing strength obtained in combination of the present drain sheet materials 1 and the soil at the surface of the slope.

EXAMPLE I

Silty clay loam with a natural water content of 60–80 per cent of dry weight (Wn) was planed to form an embankment 6.5 m high. There was concern about the sliding of the embankment and deflection of the subgrade soil, and therefore, to reduce the pore water pressure in the soil, the present drain sheet materials 1 of the type shown in FIG. 1 each having the width of 1 m and length of 10 m were employed.

Figures 7, 8:
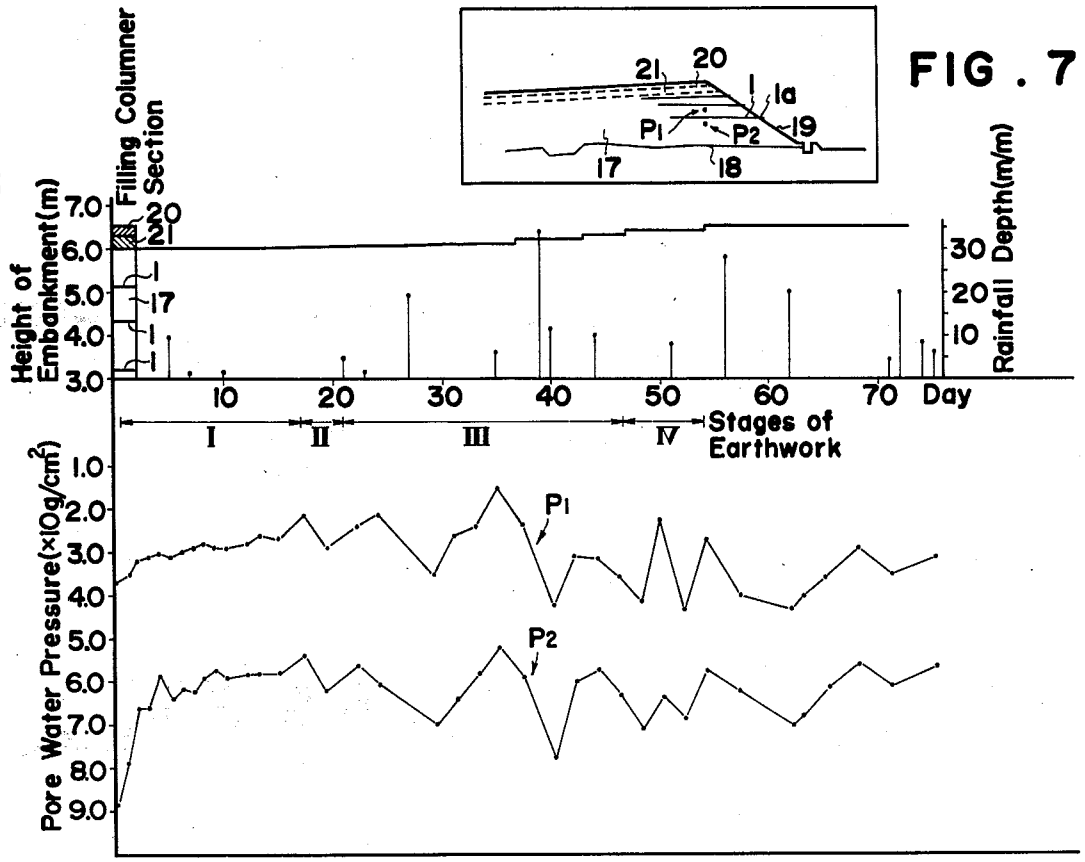
FIG. 7 is a schematic side view showing an embankment formed with the use of the present drain sheet materials.
FIG. 8 is a diagram showing changes of pore water pressure measured in the embankment of FIG. 7 during an earthwork period.

As shown in FIG. 7, the drain sheet materials 1 were buried in the embankment 17 with a horizontal pitch of 5 m and at heights of 3.3 m, 4.4 m and 5.2 m from the foundation 18 of the embankment 17 in such a manner that the drain sheet materials 1 were located on different vertical planes. Further, each drain sheet material was inclined about 3% relative to the horizontal plane in the lengthwise direction thereof. End portion 1(a) of each of the drain sheet materials was exposed about 15 cm in length through the surface of the slope 19 of the embankment 17. To make it possible to observe the changes of the pore water pressure in the embankment, two pressure gauges $P_1$ and $P_2$ were also buried at heights of 3.0 m and 4 m, respectively, from the foundation 18 of the embankment 17. A layer between the upper dotted line and the top solid line is a subgrade 20, and a layer between the upper and lower dotted lines is an improved grade 21.

Shown in FIG. 8 are values of the pore water pressure measured during an earthwork period, in which Roman figures I–IV represent, respectively, the earthwork stages of setting present drain sheet materials, grading, improved grading, and sub-grading. From the measurements, it will be seen that the excessive pore water pressure changes in connection with the rainfall depth but gradually decreases as time passes, and that the seepage pressure increasing after rainfall has rapidly decreased. It will also be noted that the banking stabilized during and after the earthworks and that the deflection of the subgrade was less than the standard value of 3 m/m.

EXAMPLE II

The present drain sheet materials of the type shown in FIG. 1 were buried in an embankment, having a high water content in per cent of dry weight and extrasensitivty ratio, to learn the adaptability of the present drain sheet materials to such embankment.

Figure 9:
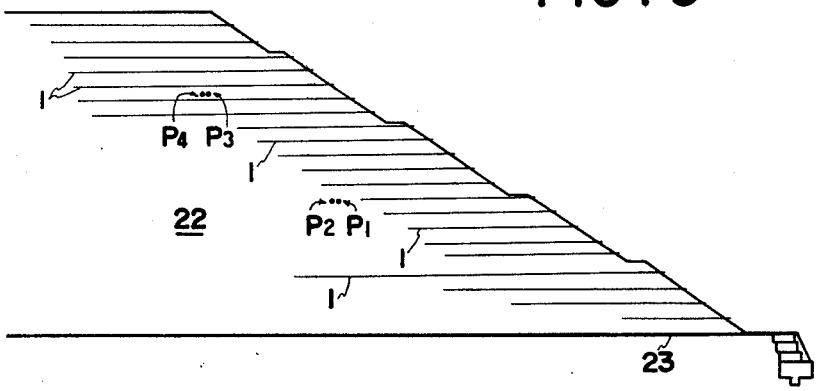
FIG. 9 is a schematic side view showing an embankment of another embodiment formed with the use of the present drain sheet materials.

As shown in FIG. 9, the present drain sheet materials 1 of various lengths of 11.4–31.6 m are buried in the embankment 22 at intervals of 1.2 m in the vertical direction. Each drain sheet material 1 has a width of 30 cm and is horizontally spaced from adjacent sheets by as much as 2.0 m. In the same way as disclosed in Example I, each drain sheet material is exposed at one end thereof and inclined relative to the horizontal level. To observe the changes of the pore water pressure in the embankment, pressure gauges $P_1$, $P_2$ and $P_3$, $P_4$ are buried in pairs at heights of about 12 m and 21 m, respectively, from the foundation 23 of the embankment 22.

Figure 10:
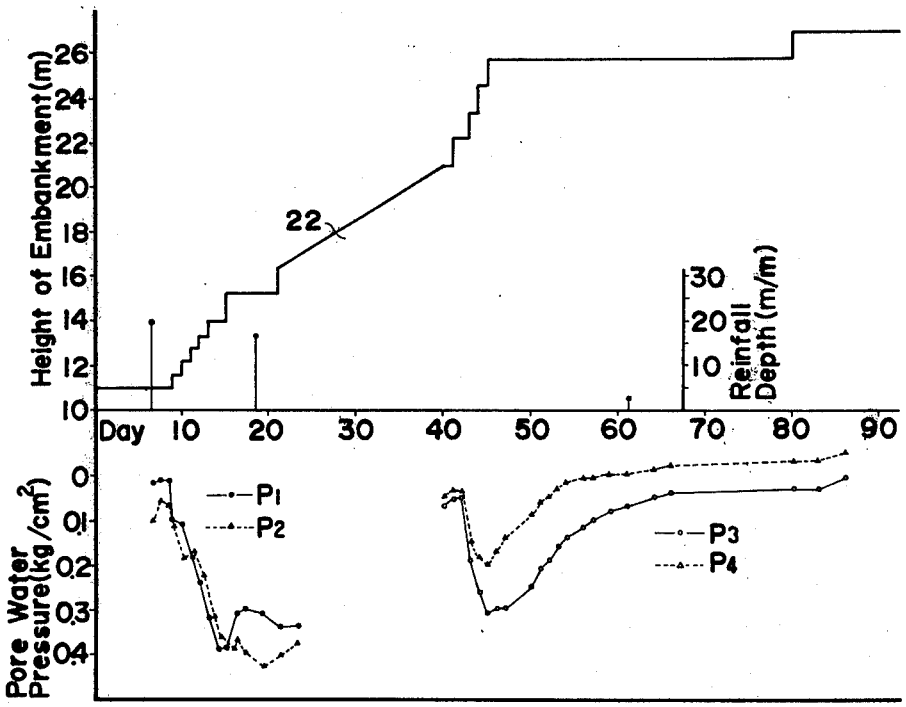
FIG. 10 is a diagram showing changes of pore water pressure measured in the embankment of FIG. 9 during an earthwork period.

Shown in FIG. 10 are values of the pore water pressure measured during earthwork periods similar to FIG. 8. The pressure gauges $P_1$ and $P_2$ were broken in the middle of the earthwork due to strain caused by high earth pressure. However, it was known from the values of the gauges $P_1$ and $P_2$ that the pore water pressure which was increased by rainfall remarkably reduced soon after the rain. From the values of the pressure gauges $P_3$ and $P_4$, it was shown that the pore water pressure after increasing to the highest point reduced to the original point within 10–20 days. This period is very short compared with the usual consolidation period. Thus, it is shown that with the use of the present drain sheet materials the trafficability of the extrasensitive soil is remakably improved.

Although the present invention has been described with reference to preferred embodiments thereof, modification and alteration may be made within the spirit of the present invention. For example, the porous and relatively dense layers 3, 3(a) attached to both surfaces of the non-woven fabric layer 2 in the embodiment shown in FIGS. 1–3 can be omitted if the flexible elongated member is entirely embedded in the non-woven fabric layer 2.

What is claimed is:

1. A drain sheet element comprising:

a non-woven fabric layer of coarse and thick structure formed of synthetic fibers of relatively high denier randomly interconnected mainly at their cross points;

a plurality of elastic spiral springs linearly and parallelly positioned and embedded in the lengthwise direction of said fabric layer; and two non-woven fabric layers of dense and thin structure, one each entirely attached to and entirely covering opposite surfaces of said coarse and thick fabric layer, each of said dense and thin non-woven fabric layers being formed of randomly interconnected man-made fibers of relatively low denier.

2. A drain structure comprising:

a plurality of spaced drain pipes, each composed of a water-permeable mat covering a perforated pipe; and a plurality of drain sheet elements placed to cross over said drain pipes in close contact therewith at their intersections, each of said drain sheet elements comprising a non-woven fabric layer of coarse and thick structure formed of synthetic fibers of relatively high denier randomly interconnected mainly at their cross points, at least one elastic spiral spring linearly positioned and embedded in the lengthwise direction of said fabric layer, and two non-woven fabric layers of dense and thin structure, one each attached to and entirely covering opposite surfaces of said coarse and thick fabric layer, each of said dense and thin non-woven fabric layers being formed of randomly interconnected man-made fibers of relatively low denier.

* * * * *